US005482278A

United States Patent [19]

Hill et al.

[11] Patent Number: 5,482,278

[45] Date of Patent: Jan. 9, 1996

[54] HANDICAPPED-ACCESSIBLE GOLF COURSE

[76] Inventors: David H. Hill; Kurt Paulin, both of P.O. Box 159, Shelbourne, Vt. 05482

[21] Appl. No.: 421,961

[22] Filed: Apr. 14, 1995

[51] Int. Cl.[6] ..... A63B 67/02

[52] U.S. Cl. ..... 273/176 A; 273/176 B

[58] Field of Search ..... 273/176 R, 176 A, 273/176 AA, 176 AB, 176 E

[56] References Cited

U.S. PATENT DOCUMENTS

| | | | |
|---|---|---|---|
| 3,084,941 | 4/1963 | Anthony | 273/176 E |
| 3,129,943 | 4/1964 | McKee | 273/176 A |
| 4,189,152 | 2/1980 | Raber | 273/176 B X |
| 5,419,561 | 5/1995 | Weber | 273/176 AB |

*Primary Examiner*—George J. Marlo
*Attorney, Agent, or Firm*—Richard L. Huff

[57] ABSTRACT

A golf course which is accessible to the physically handicapped. A clubhouse is equipped with wheelchair-accessible ramps, wheelchair-accessible toilets and necessary medical supplies and equipment. Rest houses are located on the course to provide rest, refreshment, and medical aid. The course is substantially flat to make it accessible to wheel chairs. It contains no water hazards. The surface of the greens is constructed of artificial turf. Playing hazards include boulders, concrete slabs, and sand traps. The sand traps are of such a size and arrangement so as to allow the maneuvering of wheelchairs. Blind golfers may play as the holes are equipped with buzzers which emit sounds which allow the determination of the location of the holes and additional buzzers which signal the entry of the ball into the hole.

3 Claims, 2 Drawing Sheets

HANDICAPPED-ACCESSIBLE GOLF COURSE

BACKGROUND OF THE INVENTION

1. Field of the Invention

This invention is directed to golf courses which are designed to allow access by physically handicapped golfers, such as those who are confined to wheelchairs.

2. Description of the Related Art

The golf courses in existence at the present time are designed with the physically abled in mind. The clubhouses have no special provisions for those who are confined to wheelchairs or for those who might require special medical assistance. Any refreshment stations on the course are merely shacks which offer food and beverages. There is no provision for the handicapped golfers or spectators to seek relief from the heat or cold and to rest in a bed, if such is necessary. The present courses contain streams, lakes, and artificial water hazards, which would ruin the specially constructed, sound-emitting golf balls intended to be used by the blind golfers and provide maneuvering obstacales for those golfers confined to wheelchairs. Additionally, hills and sand traps cause obstacles to those golfers confined to wheelchairs. Golfers in wheelchairs are not welcomed by conventional golf courses because pivoting turns by wheelchairs cause disruption of the grass in the green areas and fairways.

SUMMARY OF THE INVENTION

The present invention is designed to eliminate the above problems and provide a design for a golf course which is user-friendly to golfers and spectators confined to wheelchairs and can be used by blind golfers, as well. The course is designed to provide adequate facilities for the physically handicapped. Care has also been taken to provide variety in the layout of the course with the realization that handicapped golfers have fewer choices of courses than do the physically abled golfers. Obstacles such as uneven terrain and water hazards have been avoided, while still providing hazards to increase the challenge of the game. Further objects and advantages will become apparent in the detailed description which follows.

DESCRIPTION OF THE PREFERRED EMBODIMENTS

Figure 1:
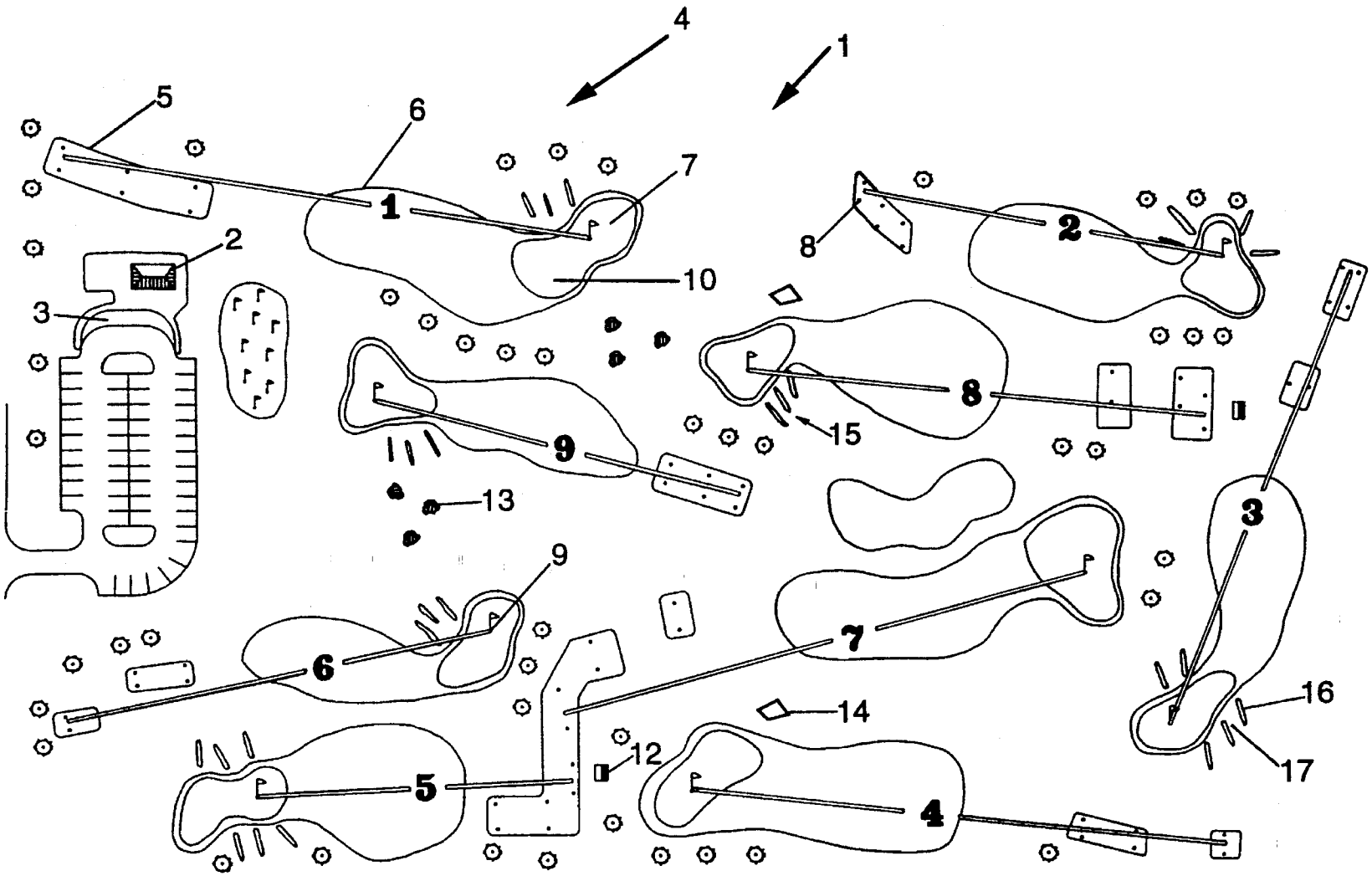
FIG. 1 is a plan view of a golf course according to this invention.

A golf course 1 according to this invention contains a clubhouse 2 with accessible ramps 3. The clubhouse 2 has at least one room equipped with a bed and necessary medical supplies, such as oxygen. The clubhouse 2 is also equipped with wheelchair-accessible toilets.

The golf course 1 has a playing surface 4 which contains tee areas 5, fairways 6, and green areas 7.

In order to increase the number of possibilities of play, the tee areas 5 have a plurality, preferably at least six, of tee positions 8 and the variation in distance between tee positions 8 to the corresponding hole 9 is significantly greater than in conventional golf courses. This is to allow for the greater difference in abilities among handicapped golfers and to provide a variety of playing conditions. It is to be noted that the golfers will be competing against their own personal best scores rather than some preselected par. To advance the ball, the golfer confined to a wheelchair may line up the ball with a spring-release club, adjust the spring to the desired level, and release the spring. Such apparatuses are known in the art.

One important feature of the present invention is that the playing surface 4 is substantially flat. This is to allow for easy access and maneuverability of wheelchairs. The fairways 6, however, have a slight pitch (similar to football fields) to allow for water drainage. Proper drainage is important as wheelchairs do not maneuver well in mud and pivoting turns by wheelchairs have a tendency to create divots in grass containing standing water.

Figure 2:
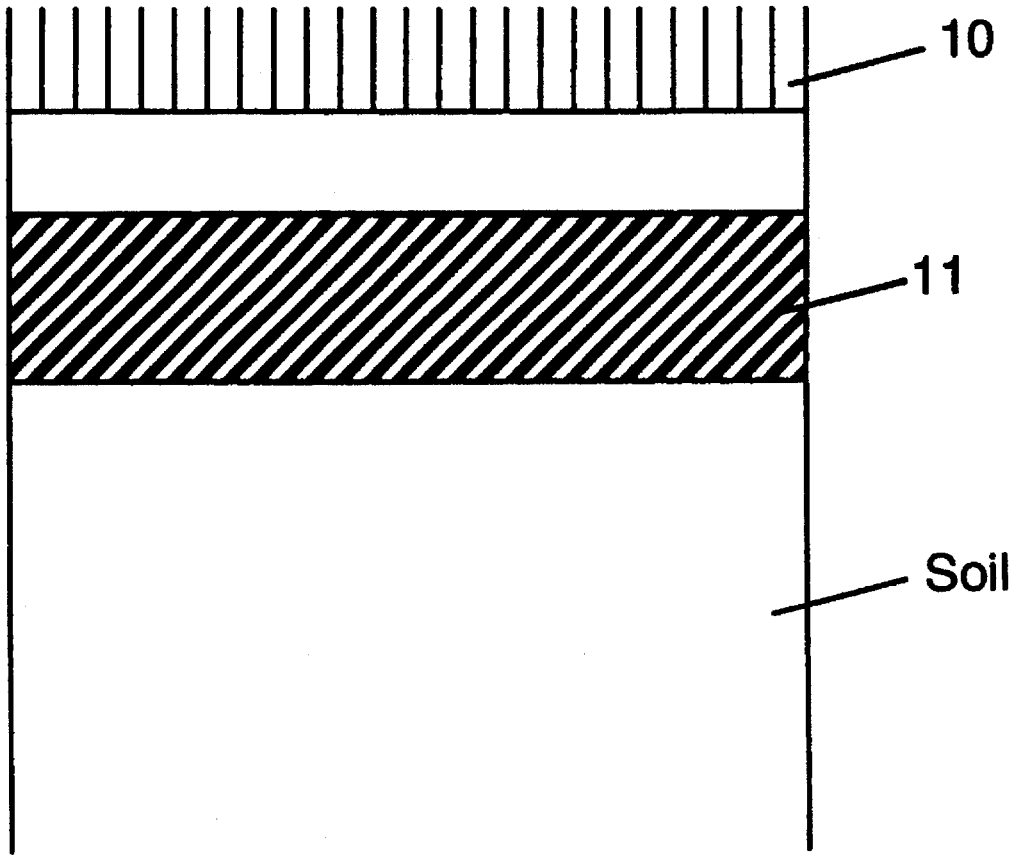
FIG. 2 is a longitudinal cross-sectional view of a section of a green area showing artificial turf and the underlying rubber matting.

The green areas 7 have a plurality of holes 9 to add to the variety of play possibilities. At any one time, all but one hole 9 per green area 7 will be plugged. A different hole 9 will be the playing hole at varying times, such a weekly. Pivoting turns by wheelchairs on short grass have a tendency to disrupt the playing surface. Accordingly, one feature of this invention is that the green areas 7 are made of artificial turf 10 such as Astroturf. As is more clearly brought out in FIG. 2, the artificial turf 10 covers a layer of rubber 11 having a thickness of approximately one-quarter to one-half inch. The purpose of this rubber layer 11 is to prevent excess bouncing of the golf ball. Additionally, the rubber mat may be manipulated so as to cause a ridge having a height of less than one inch. This ridge will not prevent or hinder progress of a wheelchair, but will be sufficient to alter the course of a putted ball, thus creating additional challenge and variety to the golf course 1.

Each golf course 1 has a plurality of water fountains (not shown) and rest houses 12 accessed by a ramp (not shown). Each rest house is climate-controlled to provide comfort and relief from the heat or cold. Also, each rest house contains refreshments and at least one bed for resting or medical emergencies.

The playing surface 4 does not contain water, such as streams, lakes, or other water traps. As mentioned above, water destroys the special balls which emit sound which are used by blind golfers. Also, water hazards make maneuverability difficult or impossible for golfers using wheelchairs. To provide challenges, the golf course 1 of the present invention does contain hazards. There are boulders 13 or other large, hard objects. Large, flat concrete slabs 14 offer hazards as a ball hitting one of these would have a tendency to bounce to produce a bad lie. The golf course 1 of this invention also uses sand traps 15. The sand traps 15 are made up of an area of sand 16 approximately forty inches wide, an area of grass 17 approximately forty inches wide, and a repeat of this pattern for the desired area. The sand is level with the ground surface, and will not prevent travel by wheelchairs.

The golf course 1 of the present invention may be used by blind golfers. The use of balls which emit sound signals, holes which emit sound signals to identify the location of the hole, and holes which emit special sound signals when a golf ball enters it are known in the art. The advantages of the golf course 1 of the present invention over conventional golf courses are the fact that the present golf course 1 does not contain water hazards, which could destroy the sound-emitting golf balls and the fact that the present golf course 1 is substantially level, making walking less hazardous.

It is contemplated that the golf courses 1 of the present invention will be staffed by medically qualified personnel. Thus, the clubhouse will have a nurse on duty, and at least some of the caddies will be trained in emergency medicine.

We claim:

1. A golf course which is accessible to physically handicapped golfers, which comprises a playing surface and:

(a) a clubhouse which is equipped with at least one wheelchair-accessible ramp, at least one room equipped with at least one bed, and toilets accessible to wheelchairs;

(b) a plurality of playing holes, each playing hole comprising (i) a tee area which comprises a plurality of areas for tee placement; (ii) a fairway area which is free from water traps, which comprises a surface which contains a pitch sufficient to afford water drainage and (iii) a green area which contains a plurality of holes which may be plugged so as to present different locations of the playing hole at different times, an artificial turf, and a rubber layer beneath the artificial turf;

(c) a plurality of climate-controlled rest houses on the course, each rest house being accessible by wheelchair ramps and containing at least one bed and refreshments; and (d) hazards which are at least one member selected from the group consisting of (i) boulders, (ii) concrete slabs which are flush with the playing surface, and (iii) sand traps which are flush with the playing surface;

the playing surface of the golf course being essentially flat except for the drainage pitch.

2. The golf course of claim 1, wherein the sand traps are arranged so that there is approximately 40 inches of sand and 40 inches of turf in a repeating series.

3. The golf course of claim 1, wherein the rubber layer beneath the artificial turf is adapted to be manipulated so as to form a ridge in the artificial turf.

* * * * *